US011236961B1

(12) United States Patent
Pineda

(10) Patent No.: US 11,236,961 B1
(45) Date of Patent: Feb. 1, 2022

(54) BARREL ASSEMBLY FOR PNEUMATIC PAINTBALL GUN

(71) Applicant: HK Army Inc., Gardena, CA (US)

(72) Inventor: Jason Jeremiah Pineda, Gardena, CA (US)

(73) Assignee: HK Army Inc., Gardena, CA (US)

( * ) Notice: Subject to any disclaimer, the term of this patent is extended or adjusted under 35 U.S.C. 154(b) by 0 days.

(21) Appl. No.: 17/330,339

(22) Filed: May 25, 2021

(51) Int. Cl.
*F41A 21/10* (2006.01)
*F41B 11/60* (2013.01)
*F41A 21/48* (2006.01)

(52) U.S. Cl.
CPC ..... *F41A 21/10* (2013.01); *F41A 21/482* (2013.01); *F41B 11/60* (2013.01)

(58) Field of Classification Search
CPC ..... F41A 21/10; F41A 21/482; F41B 11/60; F41B 11/00
See application file for complete search history.

(56) References Cited

U.S. PATENT DOCUMENTS 6,494,195 B2 * 12/2002 Perry ..... F41A 21/04 124/73
6,668,815 B1 * 12/2003 Fernandez ..... F41A 11/00 124/83
7,076,905 B2 * 7/2006 Zouboulakis ..... F41A 11/02 124/83
7,628,149 B1 * 12/2009 Zarecky ..... F41A 21/04 124/58
7,775,200 B2 * 8/2010 Anderson ..... F41A 21/02 124/83
8,875,434 B2 * 11/2014 Michal ..... F41C 27/00 42/96
9,170,066 B2 * 10/2015 Cort ..... F41B 11/70
9,341,439 B2 * 5/2016 Michal ..... F41C 23/16
2002/0078616 A1 * 6/2002 Perry ..... F41A 21/04 42/76.01
2002/0112391 A1 * 8/2002 Dillon ..... F41A 21/16 42/76.01
2002/0179074 A1 * 12/2002 Sullivan, Jr. ..... F41B 11/00 124/56
2003/0041849 A1 * 3/2003 Perry ..... F41A 21/04 124/84
2003/0182838 A1 * 10/2003 Kessler ..... F41A 21/00 42/79

(Continued)

FOREIGN PATENT DOCUMENTS

CA 2440556 A1 * 3/2005 ..... F41A 21/32

*Primary Examiner* — Benjamin P Lee
(74) *Attorney, Agent, or Firm* — Knobbe, Martens, Olson & Bear, LLP

(57) ABSTRACT

A barrel assembly for a paintball gun includes a first barrel portion, a second barrel portion, and an insert. The insert is inserted into and positioned within bores of the first barrel portion and the second barrel portion. The first barrel portion and the second barrel portion include corresponding connection mechanisms that allow the first barrel portion and the second barrel portion to removably couple with one another. The insert includes a ridge that is fixed positioned between the first barrel portion and the second barrel portion when the first barrel portion and the second barrel portion are coupled. The first barrel portion and the second barrel portions can receive inserts with different bore sizes (e.g., inner diameter).

20 Claims, 10 Drawing Sheets

(56) References Cited

U.S. PATENT DOCUMENTS

| | | | | |
|---|---|---|---|---|
| 2005/0066953 | A1* | 3/2005 | Zouboulakis | F41A 21/482<br>124/73 |
| 2005/0091901 | A1* | 5/2005 | Perry | F41B 11/00<br>42/78 |
| 2009/0071460 | A1* | 3/2009 | Anderson | F41B 11/62<br>124/80 |
| 2015/0082679 | A1* | 3/2015 | Michal | F41A 21/24<br>42/71.01 |
| 2017/0321980 | A1* | 11/2017 | Wolf | F41C 23/10 |
| 2019/0293383 | A1* | 9/2019 | Skilling | F41B 11/723 |

* cited by examiner

BARREL ASSEMBLY FOR PNEUMATIC PAINTBALL GUN

BACKGROUND

Field

Aspects of the present disclosure are directed to a barrel assembly for paintball equipment (e.g., a paintball gun), and in particular to barrel portions and a barrel insert.

Description of the Related Art

Paintball is a popular sport, where balls filled with paint (i.e., "paintballs") are shot through a barrel of a paintball gun, usually a pneumatically actuated gun. The paintballs break when they strike a surface (e.g., a target, a competitor in a paintball match) after having been expelled from the barrel of the paintball gun.

SUMMARY

Accordingly, there is a need for an improved barrel assembly for facilitating installation of a barrel insert for a paintball gun.

In accordance with one aspect of the disclosure, a barrel assembly is provided that is removably coupleable to a paintball gun. The barrel assembly comprises one or more inserts removably insertable in a barrel, the insert having a bore sized to allow a paintball of a corresponding size to pass therethrough, thereby allowing the different sized paintballs to be used with the same barrel assembly by inserting the insert corresponding with the paintball size into the barrel.

In accordance with another aspect of the disclosure, a kit is provided comprising a barrel assembly removably coupleable to a paintball gun and a plurality of elongate inserts having different inner bore sizes corresponding to different paintball diameter sizes, each of the plurality of elongate inserts configured to be removably inserted in the barrel assembly to allow paintballs of corresponding size to pass therethrough.

In accordance with another aspect of the disclosure, a paintball gun barrel assembly is provided. The paintball gun barrel assembly can include a first barrel portion, a second barrel portion, and an insert. The first barrel portion can include a proximal end, a distal end, a proximal threaded portion, and a distal threaded portion. The proximal threaded portion of the first barrel portion can removably couple to a paintball gun. The second barrel portion can include a fitting with a threaded portion. The fitting can removably couple to the distal threaded portion of the first barrel portion. The fitting can be positioned about a proximal end of the second barrel portion. The insert can be removably inserted within the first barrel portion and the second barrel portion. The insert can include a first end and a second end, where the first end can be positioned within a bore of the first barrel portion and the second end can be positioned within a bore of the second barrel portion.

The insert may optionally include a ridge on an outer surface of the insert. The ridge may be fixed between the distal end of the first barrel portion and an inner surface of the fitting when the fitting of the second barrel portion is removably coupled to the distal threaded portion of the first barrel portion. Coupling between the first barrel portion and the second barrel portion fixes the ridge between the distal end of the first barrel portion and the inner surface of the fitting.

The insert can include a proximal portion and a distal portion where the proximal portion extends between the first end and the ridge and the distal portion extends between the ridge and the second end. The lengths of the proximal portion and the distal portion may be equal. The length of the distal portion may be greater than the length of the proximal portion. The length of the proximal portion may be greater than the length of the distal portion.

The first end of the insert may optionally align with the proximal end of the first barrel portion when the insert is fully inserted into the first barrel portion.

The second barrel portion may optionally include one or more openings configured to allow air and paint to exit from a bore of the second barrel portion. The one or more openings can include one or more circular vents and one or more slits formed and positioned along at least a portion of a length of the second barrel portion.

In accordance with another aspect of the disclosure, a method of providing a barrel with an insert for a paintball gun is provided. The method can include selecting an insert based at least in part on a size of a paintball. The method can further include inserting a proximal portion of the insert into a proximal barrel portion, the proximal barrel portion including a proximal end and a distal end. The method can further include inserting a distal portion of the insert into a distal barrel portion, the distal barrel portion including a proximal end and a distal end. The method can further include coupling the distal end of the proximal barrel portion to the proximal end of the distal barrel portion. The method can further include coupling the proximal end of the proximal barrel portion to a paintball gun.

The insert may be selected by comparing the paintball with a plurality of openings of a sizing device, where each of the plurality of openings of the sizing device associated with a corresponding bore size of a given insert, identifying an opening from the plurality of openings based at least in part on the comparison of the paintball and the plurality of openings of the sizing device, and selecting the insert having a bore size corresponding to the identified opening.

The distal end of the proximal barrel portion may include a threaded portion and the proximal end of the distal barrel portion may include a fitting. The coupling between the distal end of the proximal barrel portion and the proximal end of the distal barrel portion may include removably coupling the fitting of the proximal end of the distal barrel portion to the threaded portion of the distal end of the proximal barrel portion.

In accordance to another aspect of the disclosure, a kit for a paintball is provided. The kit can include a first barrel portion, a second barrel portion, and one or more inserts. The one or more inserts can be inserted into the first barrel portion and the second barrel portion. Each of the one or more inserts can have a different bore size.

Each of the one or more inserts may optionally include a ridge on an outer surface thereof. The ridge can be positioned and fixed between a distal end of the first barrel portion and a proximal end of the second barrel portion to thereby fix a position of the insert relative to the first and second barrel portions.

The one or more inserts may optionally be in different colors each corresponding to a different inner bore size.

The kit may optionally include a sizing device comprising a plurality of openings. The plurality of openings can correspond to different paintball sizes and bore sizes of the one or more inserts. The kit may optionally include one or more barrel grips that can removably wrap around an outer surface of the first barrel portion and provide improved grip for a user. The one or more barrel grips can be in different colors.

DETAILED DESCRIPTION

Figure 1:
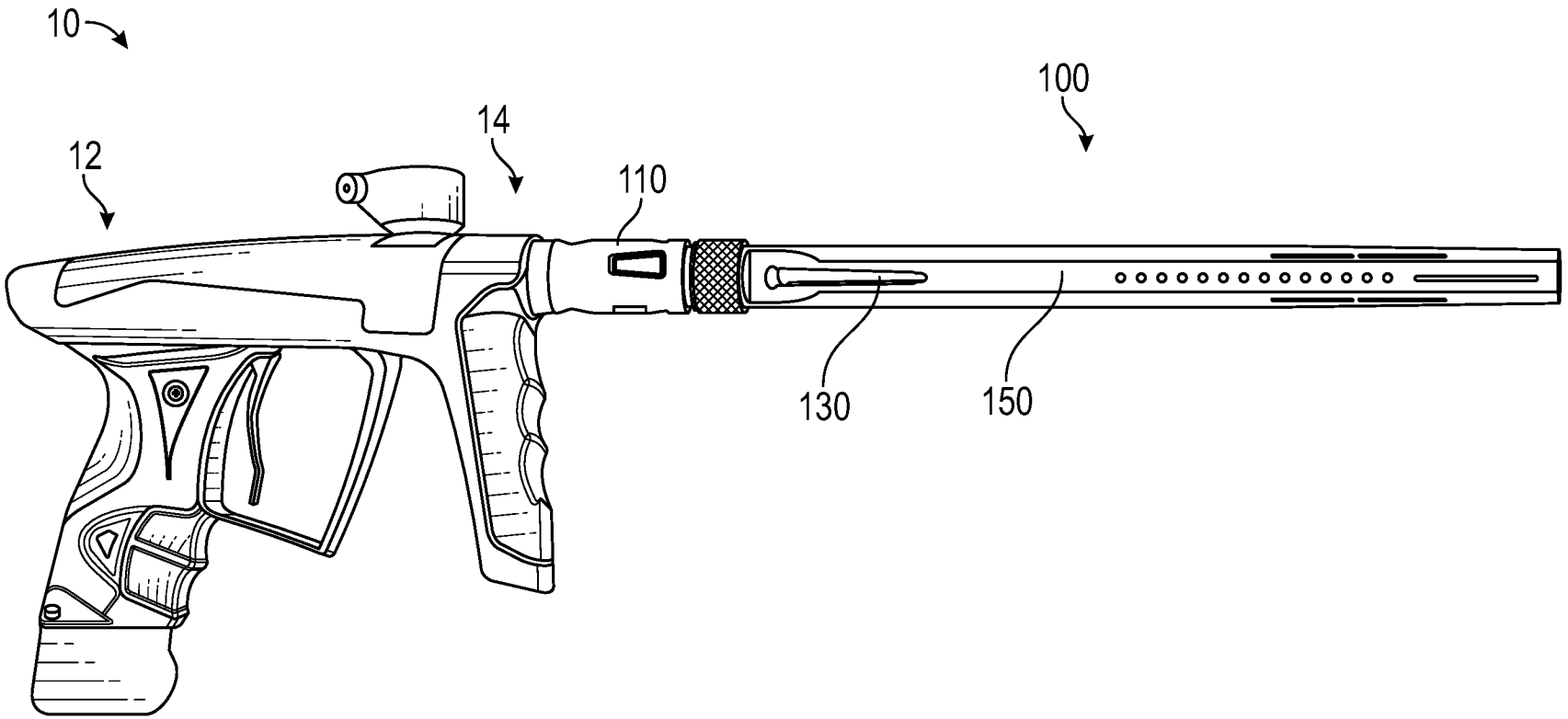
FIG. 1 illustrates a side view of a paintball gun with an embodiment of a barrel assembly with a barrel insert.

FIG. 1 illustrates a paintball gun 10 coupled with a barrel assembly 100. The paintball gun 10 can include a handle portion 12 and an adapter portion 14 that can be coupled with the barrel assembly 100. For example, the adapter portion 14 and the barrel assembly 100 can include corresponding threads that allow the barrel assembly 100 to be removably coupled with the adapter portion 14 of the paintball gun 10. Other types of suitable connectors may be used to removably attach the barrel assembly 100 to the adapter portion 14. The adaptor portion 14 may be suitable to connect other types of barrel assemblies to the paintball gun 10.

The barrel assembly 100 can include a first barrel portion 110 (e.g., a rear barrel portion), an insert 130, and a second barrel portion 150 (e.g., a front barrel portion). The inner diameter of the insert 130 can vary to accommodate paintballs in different sizes. For example, in order to provide adequate control and delivery of a paintball traveling therethrough, the insert 130 can have an inner diameter that is slightly greater than the outer diameter of the paintball. If the inner diameter of the insert 130 is too large compared to the outer diameter of a paintball, the gaps between the paintball and the inner surface of the insert 130 can negatively impact trajectory of the paintball in the insert 130 and negatively impact the accuracy of the paintball gun 10. On the other hand, if the inner diameter of the insert 130 is not sufficiently greater (e.g., substantially the same) than the outer diameter of a paintball, the inner surface of the insert 130 can create unnecessary contacts with the paintball and negatively effect, for example, the speed and the spin rate of the paintball, or may break the paintball.

In order to allow users to readily distinguish inserts 130 with different sizes, the inserts 130 can include designs printed on the outer surfaces of the inserts 130. In some implementations, the designs can include the bore sizes or some other identifier that allows a user to identify a corresponding insert for a particular sized paintball. Additionally or alternatively, the designs can be in different colors corresponding to different sizes. The different colors can associated with different colors so that users can easily recognize and distinguish inserts 130 of different sizes.

In some implementations, the outer diameter of the inserts 130 can remain the same while having different inner diameters to accommodate paintballs in different sizes. This can allow the inserts 130 for different paintball sizes to have the same fit inside the first barrel portion 110 and the second barrel portion 150.

Figure 2C:
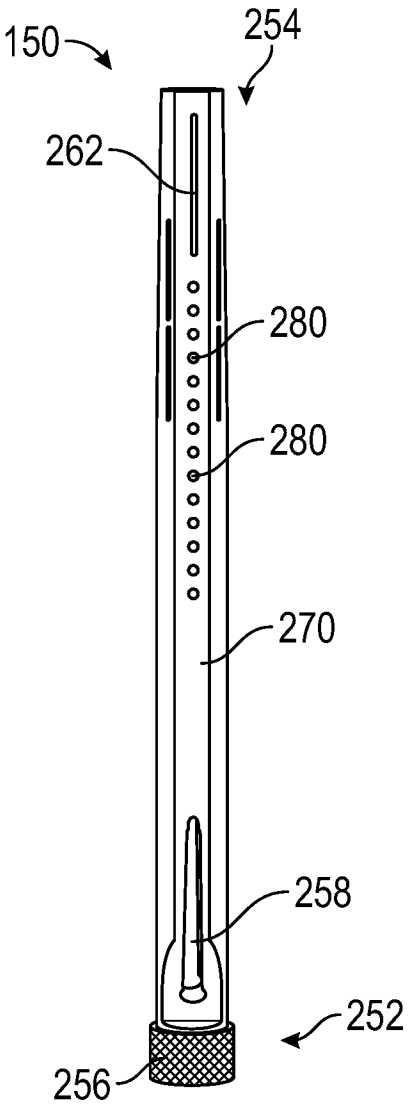
FIG. 2C illustrates a top view of an embodiment of a front barrel portion.
Figure 2B:
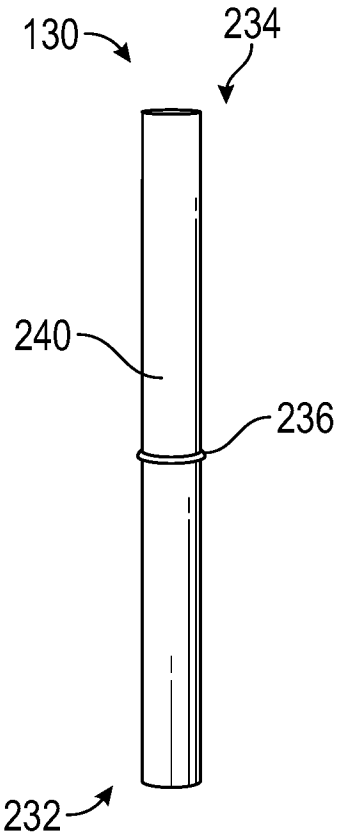
FIG. 2B illustrates a top view of an embodiment of a barrel insert.
Figure 2A:
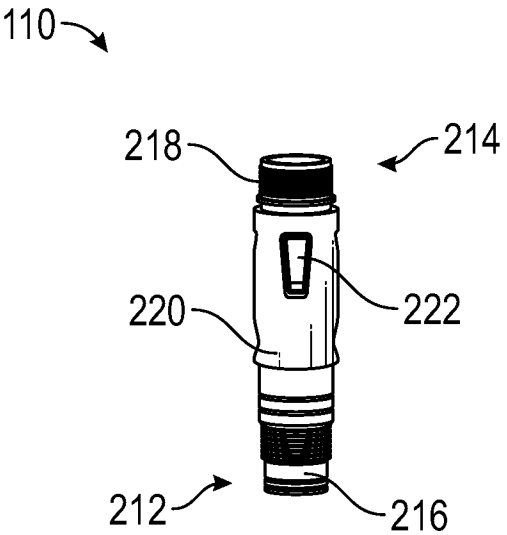
FIG. 2A illustrates a top view of an embodiment of a rear barrel portion.
Figure 2D:
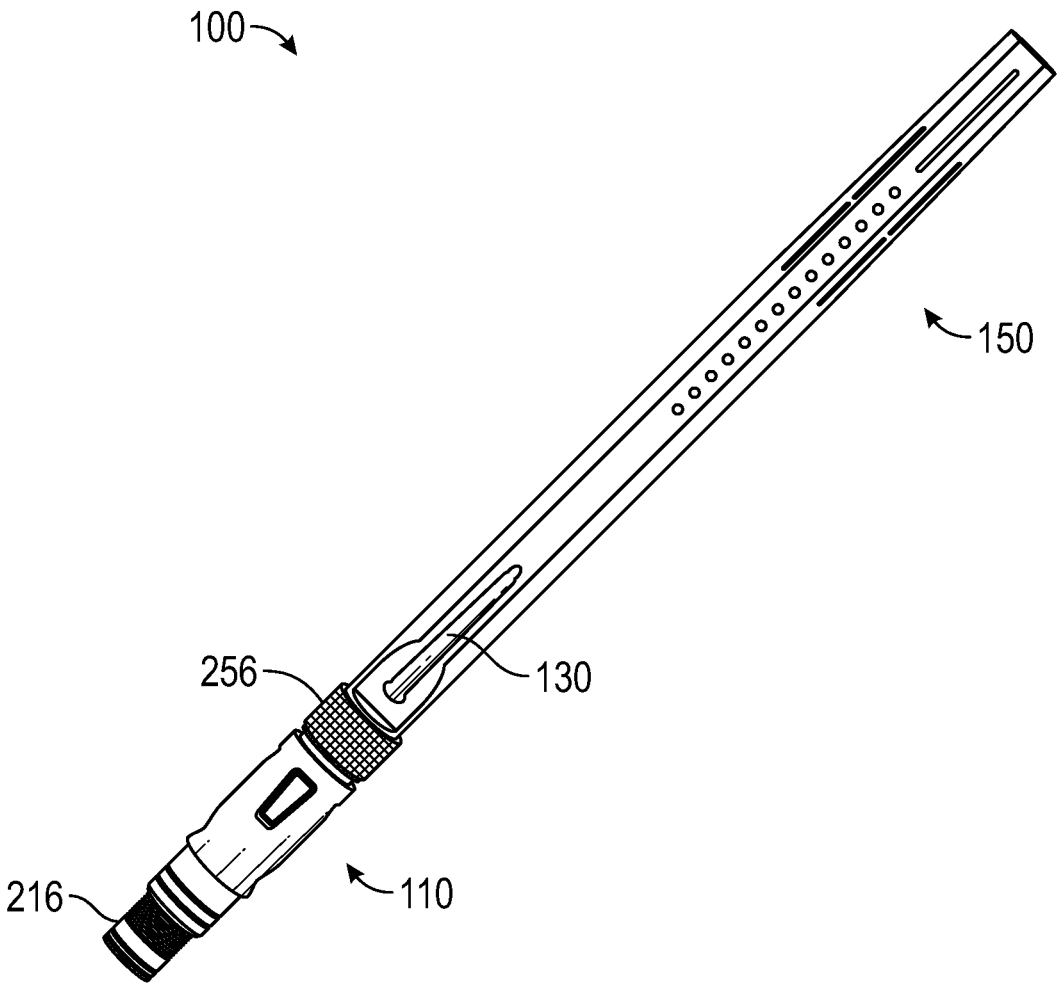
FIG. 2D illustrates a top view of an embodiment of a barrel assembly with the rear barrel portion of FIG. 2A, the front barrel portion of FIG. 2C, and the barrel insert of FIG. 2B.

With reference to FIGS. 2A-2D, the first barrel portion 110 can include a body 220 including a proximal end 212 (e.g., a rear end or an end pointing towards to a user while shooting), a distal end 214 (e.g., a front end or an end pointing away from a user while shooting), a proximal threaded portion 216, a distal threaded portion 218, and an opening 222. The second barrel portion 150 can include a body 270 including a proximal end 252 (e.g., a rear end or an end pointing towards to a user while shooting), a distal end 254 (e.g., a front end or an end pointing away from a user while shooting), a fitting 256, openings 258, circular vents 260, and slits 262. The insert 130 can include a body 240 including a first end 232 (e.g., a proximal end or an end pointing towards to a user while shooting), a second end 234 (e.g., a distal end or an end pointing away from a user while shooting), and a ridge 236 that extends from an outer surface of the insert 130, where a diameter or width of the insert 130 at the ridge 236 is greater than a diameter or width of the insert 130 at other locations of the insert 130 (e.g., greater than a diameter or width of the insert 130 at any other location of the insert 130). The diameter or width of the insert 130 at the ridge 236 may be sufficient to ensure that the ridge 236 comes into contact against, for example, the distal end 214 of the first barrel portion 110. Additionally, the diameter or width of the insert 130 at the ridge 236 may be sufficient to ensure that the ridge 236 comes into contact against, for example, the proximal end 254 (or the end surface 302 as shown in FIG. 3E) of the second barrel portion 150. In some implementations, the height of the ridge (e.g., how far the ridge extends away from the outer surface of the body 240 of the insert 130) can be substantially equal to the thickness of the body 220 of the first barrel portion 110 and/or the thickness of the body 270 of the second barrel portion 150. In some implementations, the height of the ridge can be between about 0.5 mm and about 2 mm, between about 0.7 mm and about 1.8 mm, between about 0.9 mm and about 1.6 mm, between about 1.1 mm and about 1.5 mm, or about 0.5 mm, 0.7 mm, 0.9 mm, 1.1 mm, 1.3 mm, 1.5 mm, 1.7 mm, 2 mm, or ranges including any two of the aforementioned values. The ridge 236 may or may not be integrated with the body 240 of the insert 130.

The bodies 220, 270 of the first barrel portion 110 and the second barrel portion 150, respectively, can each have a bore and openings that can receive the insert 130. For example, the distal end 214 of the first barrel portion 110 and the proximal end 252 of the second barrel portion 252 can include openings that can slidingly receive the insert 130 such that the insert 130 can be received within the bores of the first barrel portion 110 and the second barrel portion 150. The inner diameters of the bores of the bodies 220, 270 can be dimensioned to provide a snug fit (e.g., with minimal play) between the first barrel portion 110 and the insert 130, and between the second barrel portion 150 and the insert. For example, when the insert 130 is positioned within the bore of the bodies 220, 270 of the first barrel portion 110 and the second barrel portion 150, respectively, the gap between the outer surface of the body 250 of the insert 130 and the inner surfaces of the bodies 220, 270 may be close to zero (e.g., no room to allow the insert 130 to move about within the bores of the bodies 220, 270). The minimal gap between the insert 130 and the first barrel portion 110 and the second barrel portion 150 can advantageously prevent the insert 130 from moving within the first barrel portion 110 and the second barrel portion 150 during use, and therefore increase accuracy of paintballs exiting the barrel assembly 100.

The proximal threaded portion 216 of the first barrel portion 110 can include threads that correspond to, for example, threads of the adapter portion 14. As such, as described herein, the proximal threaded portion 216 can allow the first barrel portion 110 to removably couple to the adapter portion 14.

The distal threaded portion 218 of the first barrel portion 110 can couple (e.g., removably connect) with the fitting 256 of the second barrel portion 150 to connect the first barrel portion 110 and the second barrel portion 150. In some implementations, the fitting 256 can include threads (e.g., formed on an inner surface/wall of the fitting 256) that corresponds to the threads of the distal threaded portion 218. Once the threads of the fitting 256 and the threads of the distal threaded portion 218 engage one another, the fitting 256 can be rotated onto (e.g., clockwise) the distal threaded portion 218. The connection between the distal threaded portion 218 and the fitting 256 can cause the second barrel portion 150 to move towards the first barrel portion 110.

In some implementations, the fitting 256 may be integrated to the second barrel portion 150 such that rotation of the fitting 256 causes rotation of the second barrel portion 150. Alternatively, the fitting 256 may be a modular component rotatably coupled to the second barrel portion 150 such that rotation of the fitting 256 does not translate to the second barrel portion 150 (e.g., the fitting 256 can be rotated without rotating the second barrel portion 150).

The openings 222, 258 of the first barrel portion 110 and the second portion 120, respectively, can show portions of the insert 130, for example, when the insert 130 is positioned within the bores of the first barrel portion 110 and the second barrel portion 150. As described herein, the inserts 130 can be of different sizes to accommodate paintballs of different sizes. In order to provide adequate control and delivery as a paintball travels through the insert 130, the inner diameter of the insert 130 may be of a certain size relative to the outer diameter of the paintball (e.g., slightly greater than the diameter of the paintball). If the inner diameter of the insert 130 is too close in relation to the diameter of the paintball, the inner surface of the insert 130 can break the paintball. If the inner diameter of the insert 130 is too big in relation to the diameter of the paintball, there may be too much air flow through the gaps between the inner surface of the insert 130 and the outer surface of the paintball, which can negatively affect the velocity and/or accuracy of the paintball traveling through the barrel assembly 100. In order to allow users to readily distinguish inserts 130 with different sizes, the inserts 130 can include designs or text (e.g., indicating different bore sizes) or other indicia printed (or etched) on the outer surface of the inserts 130. In some implementations, the designs can include the bore sizes. Additionally or alternatively, the designs can be in different colors that correspond to different bore sizes (e.g., inner diameter of the inserts 130). The openings 222, 258 can show portions of the designs, texts, or colors (e.g., indicating different bore sizes) on the inserts 130 to allow the users to readily identify the insert 130 being used.

The circular vents 260 can allow the air to escape from the bore of the second barrel portion 150 (e.g., to ambient) as paintballs travel through the second barrel portion 150 and exit the barrel assembly 100. The circular vents 260 can provide improved control or speed of the paintballs as they travel through the second barrel portion 150 by, for example, reducing the amount of air resistance in the bore of the second barrel portion 150 experienced by paintballs travelling through the second barrel portion 150. In some implementations, the circular vents 260 can reduce the amount of turbulent air flow within the bore of the second barrel portion 150 when paintballs travel through the barrel assembly 100. As shown in FIG. 2C, the second barrel portion 150 can include multiple sets of circular vents 260 linearly positioned along at least a portion of the length of the second barrel portion 150 at different angular positions (e.g., four different sets of vents 260 positioned at 90 degrees apart from adjacent sets of vents 260). In some implementations, the circular vents 260 can be formed in a helical manner around and extending along the length of the body 270. In some implementations, sets of the circular vents 260 can be formed around the circumference of the body 270 (e.g., in a circular manner) and each of the sets can be spaced apart from each other along the length of the body 270.

During use, paintballs can sometimes burst (e.g., break apart) while traveling through the barrel assembly 100, and paint inside the paintballs can smear against the inner walls of the second barrel portion 150 and collect over time. The slits 262 can allow the paint to exit from the bore of the second barrel portion 150 and inhibit (e.g., prevent) paint buildup within the bore of the second barrel portion 150. This can further reduce the amount of interference experienced by paintballs travelling through the barrel assembly 100. The slits 262 can, as shown in FIG. 2C, extend along at least a portion of the length of the second barrel portion 150. Additionally, the slits 262 can be positioned at various angular positions (e.g., six different slits 260 positioned at 60 degrees apart from adjacent slits 260). In some implementations, the slits 262 can extend in a helical manner around the circumference and extending along the length of the body 270.

With reference to FIGS. 3A-3E, an example process of assembling the barrel assembly 100 is described herein. The insert 130 can be inserted into the first barrel portion 110 via the distal end 214. The bore of the first barrel portion 110 can be sufficiently large to accommodate (e.g., receive) the inserts 130 in different sizes (e.g., different bore sizes). When inserted in the first barrel portion 110, the ridge 236 of the insert 130 can be proximal to or abut against (e.g., positioned adjacent to) an end surface 300 of the distal end 214 of the first barrel portion 110. The contact between the end surface 300 and the ridge 236 can prevent further insertion of the insert 130 into the first barrel portion 110.

The ridge 236 can indicate how much of the insert 130 may be inserted into the bore of the first barrel portion 110 for the barrel assembly 100. In the example illustrated in FIG. 2A-2D, the ridge 236 can be positioned so that the length of the portion of the insert 130 between the proximal end 232 and the ridge 236 (e.g., the portion of the insert 130 to be inserted within the first barrel portion 110) can be the same as the length of the first barrel portion 110. As such, the first end 232 (e.g., the proximal end) of the insert 130 can align with (e.g., positioned along the same plane orthogonal to the first barrel portion 110 and the insert 130) the proximal end 212 of the first barrel portion 110 when the ridge 236 abuts against end surface 300 of the distal end 214. This can advantageously allow paintballs exiting the paintball gun 10 to directly enter into the insert 130 (and therefore into the barrel assembly 100) and inhibit (e.g., prevent) the paintballs from contacting the proximal end 232 of the insert 130 (or inner surface of the first barrel portion 110) and possibly bursting.

In some implementations, the ridge 236 can be positioned so that the first end 232 (e.g., the proximal end) of the insert 130 may extend beyond the proximal end 212 (e.g., towards the paintball gun 10) or may be positioned before the proximal end 212 (e.g., away from the paintball gun 10).

In some implementations, the length of the portion of the insert 130 between the proximal end 232 and the ridge 236 (e.g., a proximal portion) may be the same as the length of the portion of the insert 130 between the ridge 236 and the distal end 234 (e.g., a distal portion). This can advantageously allow users to insert the insert 130 into the first barrel portion 110 without having to worry about the orientation of the insert 130. In other words, if the portion of the insert 130 between the proximal end 232 and the ridge 236 and the portion of the insert 130 between the ridge 236 and the distal end 234 have the same length, either the first end 232 or the second end 234 of the insert 130 can be inserted into the first barrel portion 110.

Alternatively, the length of the portion of the insert 130 between the proximal end 232 and the ridge 236 (e.g., a proximal portion) and the length of the portion of the insert 130 between the ridge 236 and the distal end 234 (e.g., a distal portion) may be different. In some implementations, the portion of the insert 130 between the ridge 236 and the distal end 234 (e.g., a distal portion) may be shorter or longer than the portion of the insert 130 between the proximal end 232 and the ridge 236 (e.g., a proximal portion). According to some aspects, it may be advantageous to have the portion of the insert 130 between the distal end 234 and the ridge 236 (e.g., a distal portion) longer than the portion of the insert 130 between the proximal end 232 and the ridge 236 (e.g., a proximal portion). Such configuration can allow the insert 130 to extend further into the bore of the second barrel portion 150, which can provide better control and delivery of a paintball out of the barrel assembly 100 through the insert 130 and the second barrel portion 150. In some implements, the first barrel portion 110 may be longer than the second barrel portion 150, and in such example, it may be advantageous for the proximal portion (e.g., the portion of the insert 130 between the proximal end 232 and the ridge 236) to be longer than the distal portion (e.g., the portion of the insert 130 between the distal end 234 and the ridge 236).

Figure 3A:
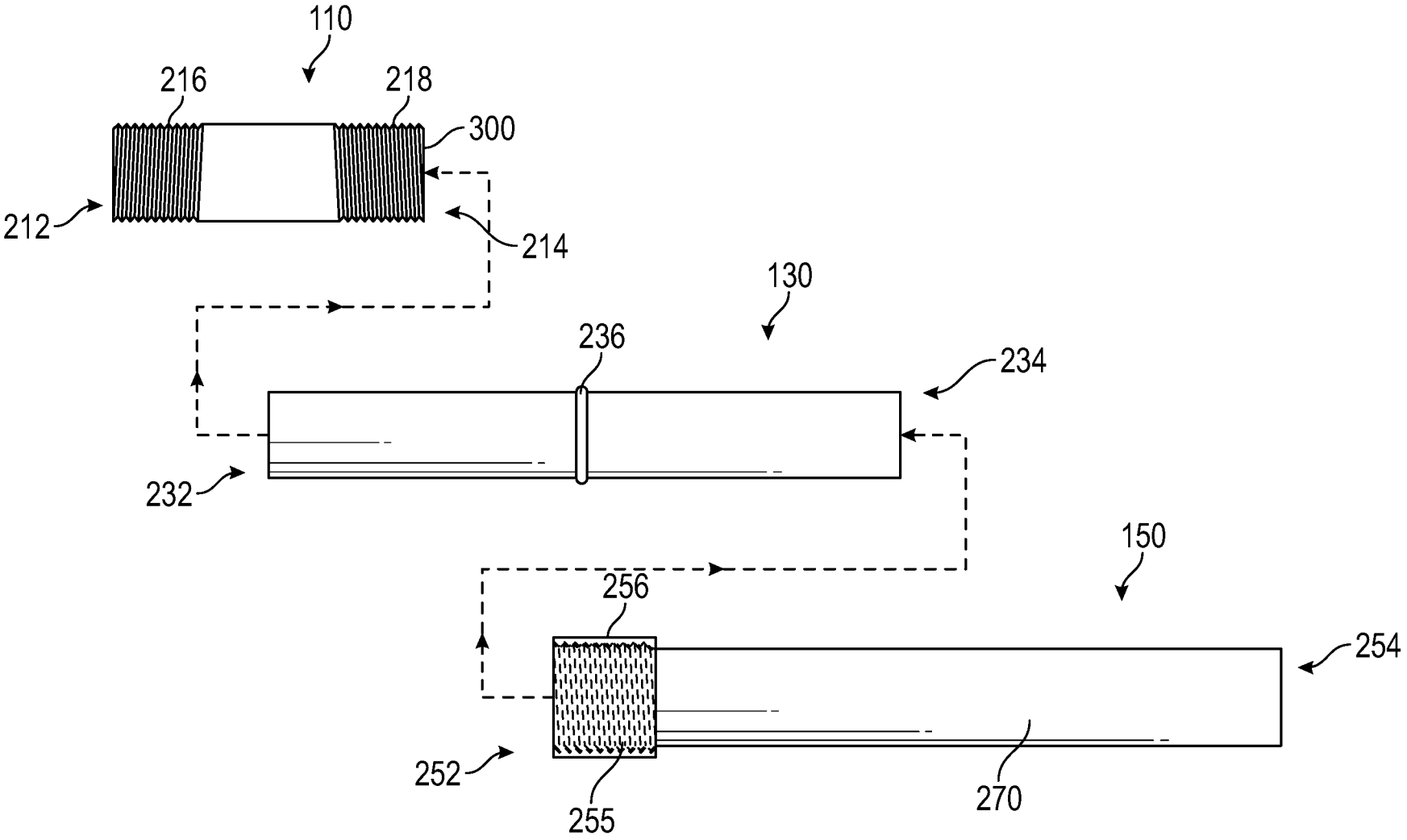
FIGS. 3A-3D illustrate schematic diagrams showing an example process of assembling a barrel with a barrel insert for a paintball gun.
Figure 3B:
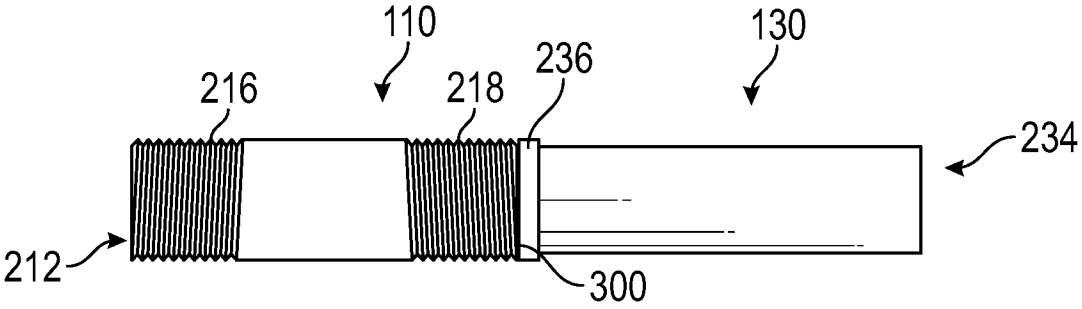
Figure 3C:
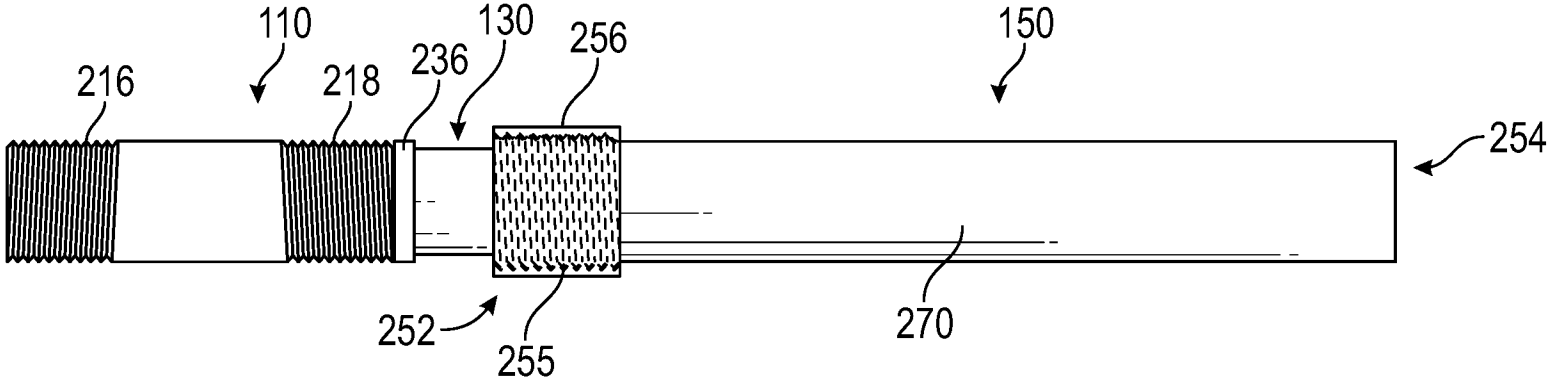
Figure 3D:
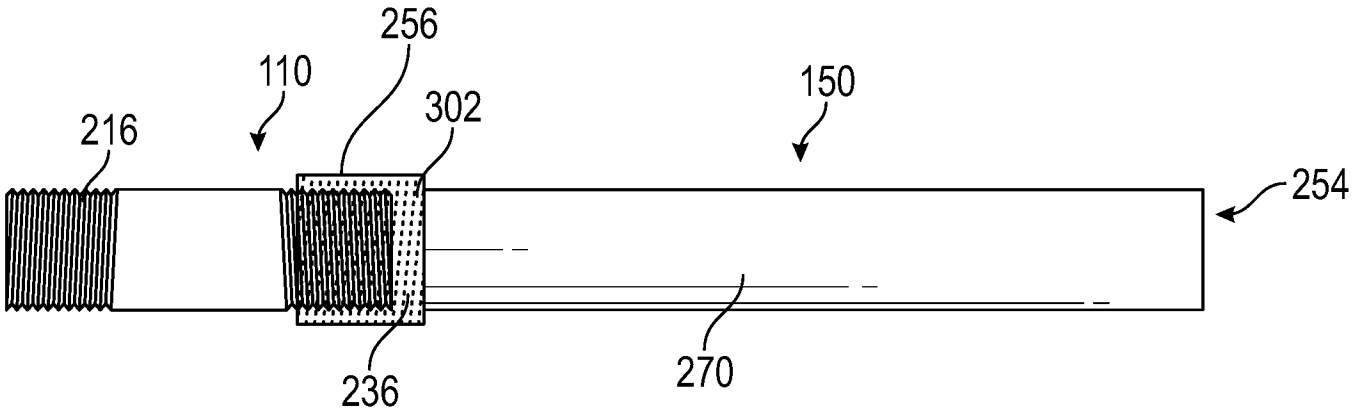
Figure 3E:
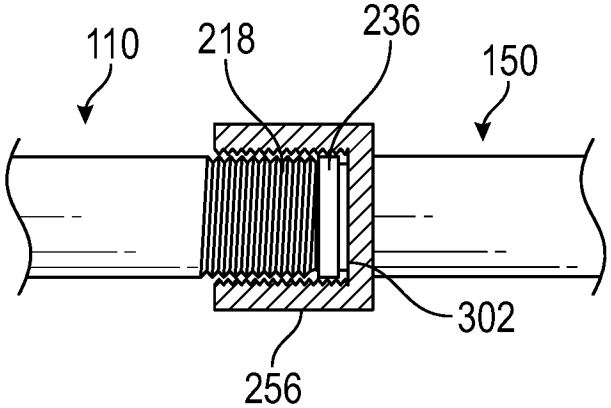
FIG. 3E illustrates a schematic diagram of a portion of a barrel assembly of FIG. 2D showing connections between the rear barrel portion of FIG. 2A, the front barrel portion of FIG. 2B, and the barrel insert of FIG. 2C.

Once the insert 130 is inserted into the bore of the first barrel portion 110, the second barrel portion 150 can be slid over a remaining portion of the insert 130 (as shown in FIGS. 3A and 3C) such that the fitting 256 faces and moves towards the distal threaded portion 218 of the first barrel portion 110. The inner diameter of the second barrel portion 150 may be sufficiently large to accommodate (e.g., receive) the inserts 130 with different bore sizes. As described herein, the fitting 256 can be integrated to the body 270 of the second barrel portion 150 or can move separately from the body 270 of the second barrel portion 150. If the fitting 256 is integrated to the body 270 of the second barrel portion 150, both the fitting 256 and the body 270 can slide over the insert 130 toward the first barrel portion 110. If the fitting 256 is not integrated to the body 270 (e.g., can move separately from the body 270), then the body 270 can slide over the insert 130 first and the fitting 256 can be slid over and towards the distal threaded portion 218 of the first barrel portion 110.

Once the fitting 256 is brought sufficiently close to the distal threaded portion 218, the fitting 256 can be rotated (e.g., clockwise) to cause threads 255 of the fitting 256 to engage the threads of the distal threaded portion 218 of the first barrel portion 110. For example, clockwise rotation of the fitting 256 (e.g., when in a proximal direction towards the paintball gun 10 from the distal end 254 of the second barrel portion 150) can cause the threads of the fitting 256 to engage the threads of the distal threaded portion 218. The rotation (e.g., clockwise) of the fitting 256 can cause the second barrel portion 150 to move further towards the first barrel portion 110 until the ridge 236 is fixedly wedged between the first barrel portion 110 and the second barrel portion 150. For example, the ridge 236 may be fixedly wedged between the end surface 300 of the distal end 214 of the first barrel portion 110 and an end surface 302 (as shown in FIG. 3E). For example, the end surface 302 may be a portion of an inner surface of the fitting 256 that can abut against the ridge 236. Alternatively, the end surface 302 may be a proximal end surface of the body 270 of the second barrel portion 150. Since the ridge 236 is fixed connected to the body 240 of the insert 130, when the ridge 236 is fixed between the first barrel portion 110 and the second barrel portion 150, the body 240 of the insert 130 may advantageously be fixed in position (e.g., solely by the coupling of the fitting 256 and distal threaded portion 218) within the bores of the first barrel portion 110 and the second barrel portion 150 (e.g., unable to slide within the bores of the first barrel portion 110 and the second barrel portion 150).

Figure 4A:
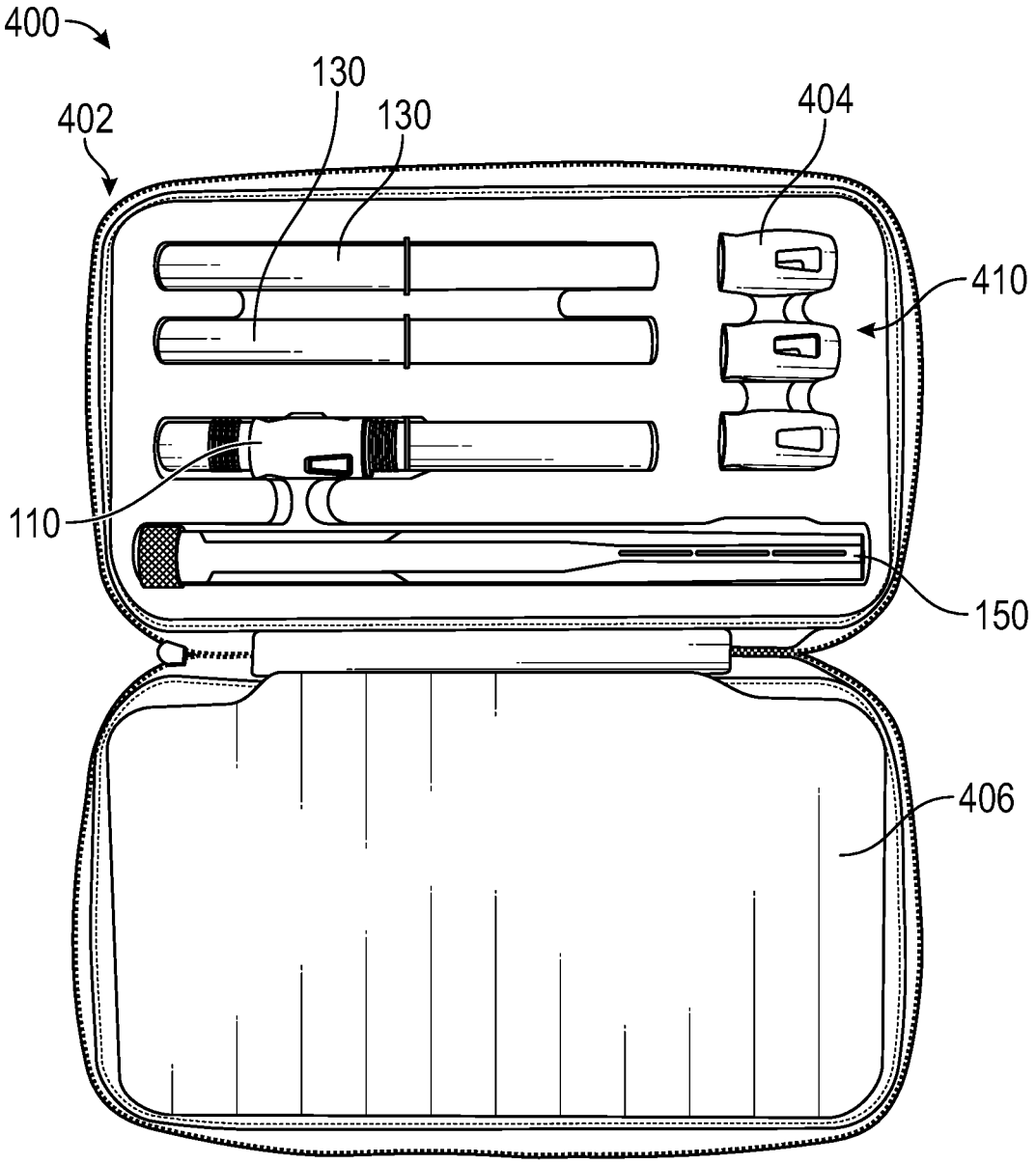
FIGS. 4A and 4B illustrate various views of an embodiment of a kit for a barrel with a barrel insert.
Figure 4B:
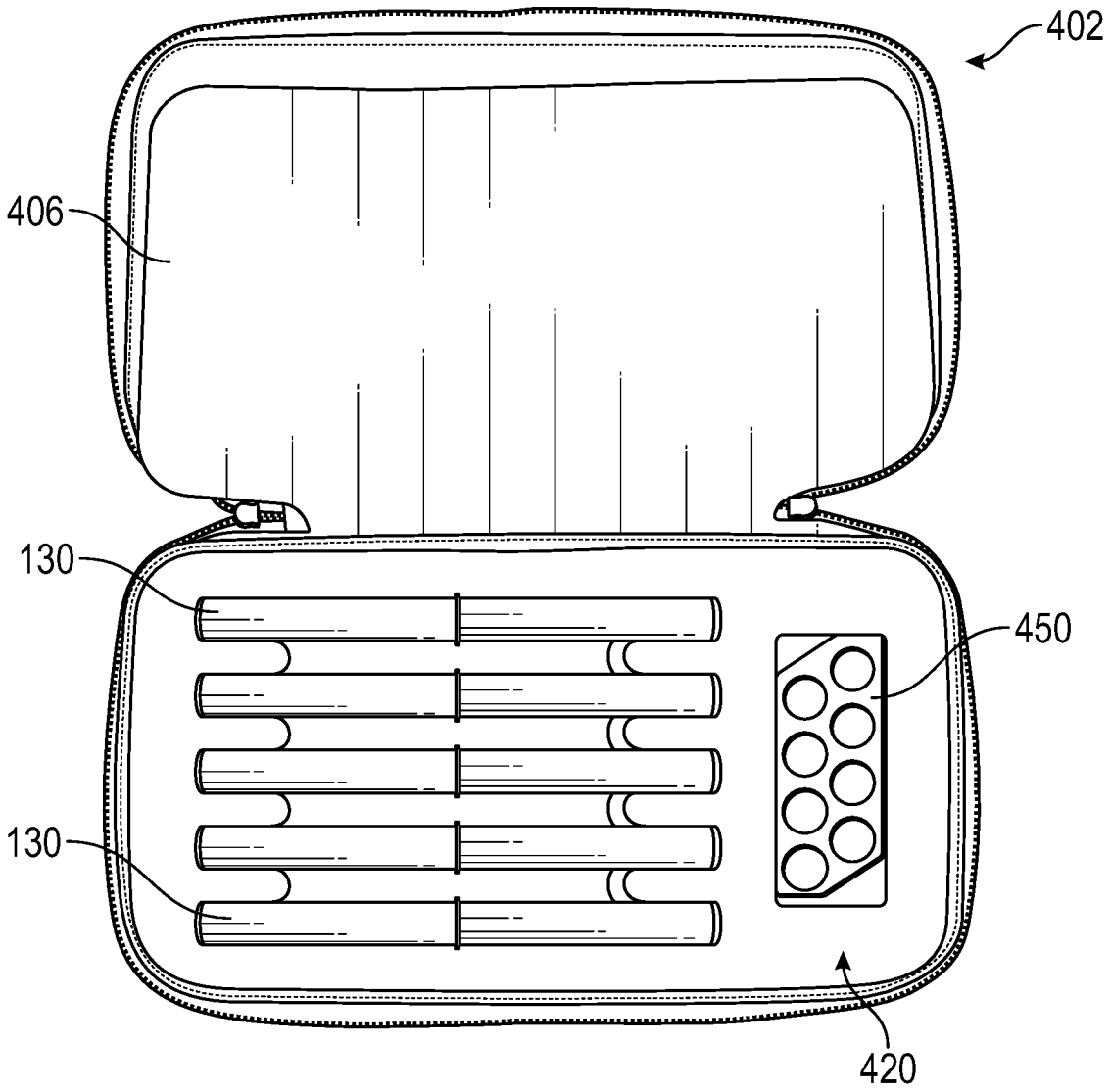

FIGS. 4A and 4B illustrate an example of a kit 400 for the barrel assembly 100. The kit 400 can include the first barrel portion 110, the second barrel portion 150, one or more inserts 130 (e.g., with different bore sizes for different paintball sizes), one or more barrel grips 404, and a sizing device 450. The different items included in the kit 400 may be stored in a container 402 that can include a first compartment 410 and a second compartment 420 separated by a divider 406. The barrel grips 404 can be disposed over the first barrel portion 110 and provide improved grip for users. In some implementations, the grips 404 can be in different colors so that users can choose a color to match, for example, their gears (e.g., paintball gun, clothes, etc.).

Figure 5:
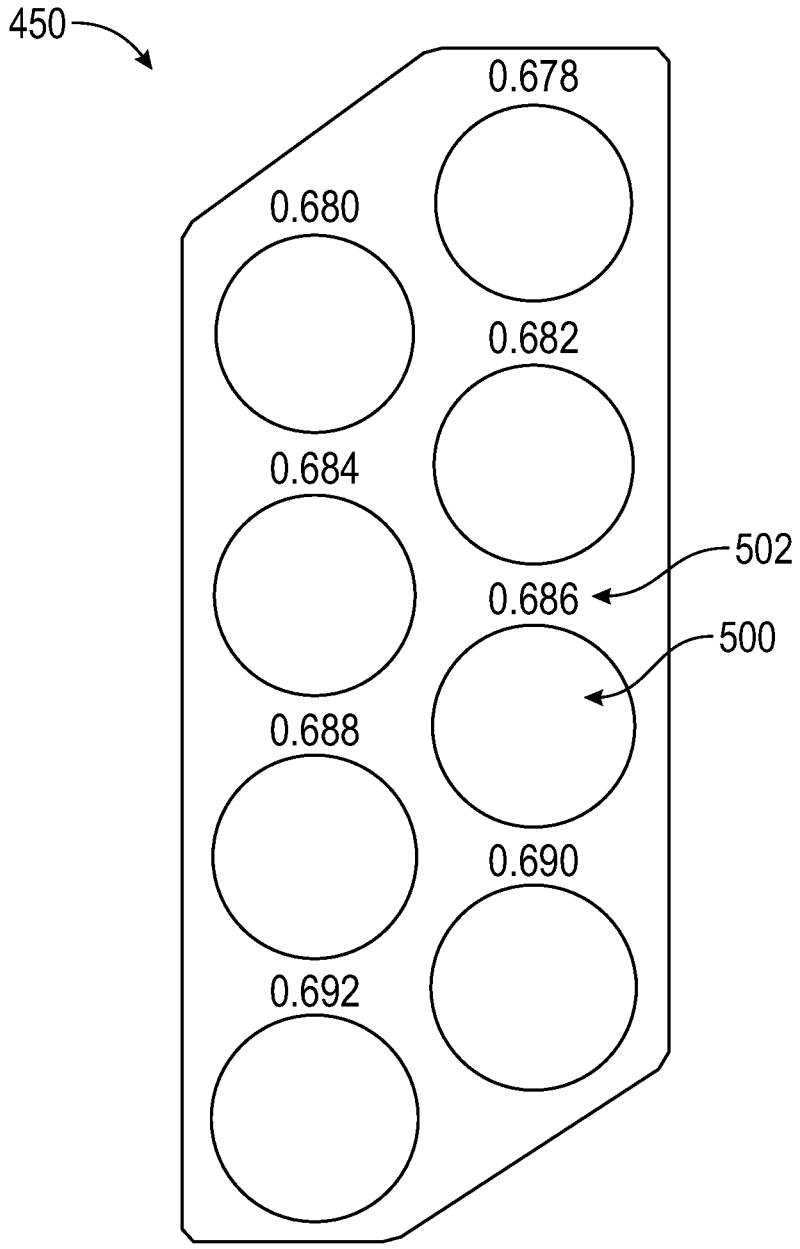
FIG. 5 illustrates a top view of an embodiment of a sizing device for a barrel with a barrel insert.

FIG. 5 illustrates an example of the sizing device 450. The sizing device 450 can include openings 500 and barrel size indicators 502. The one or more inserts 130 can have the same barrel size indicators 502 (e.g., on an outer surface thereof), allowing the user to match the insert 130 with the paintball size via the indicator 502. A user may place a paintball in the openings 500 to determine which of the openings 500 provides the best fit for the paintball. Once the user chooses an opening that provides the best fit for the paintball, the user can read a corresponding barrel size indicator and choose the insert 130 with the same barrel size indicator for the chosen opening.

Figure 6:
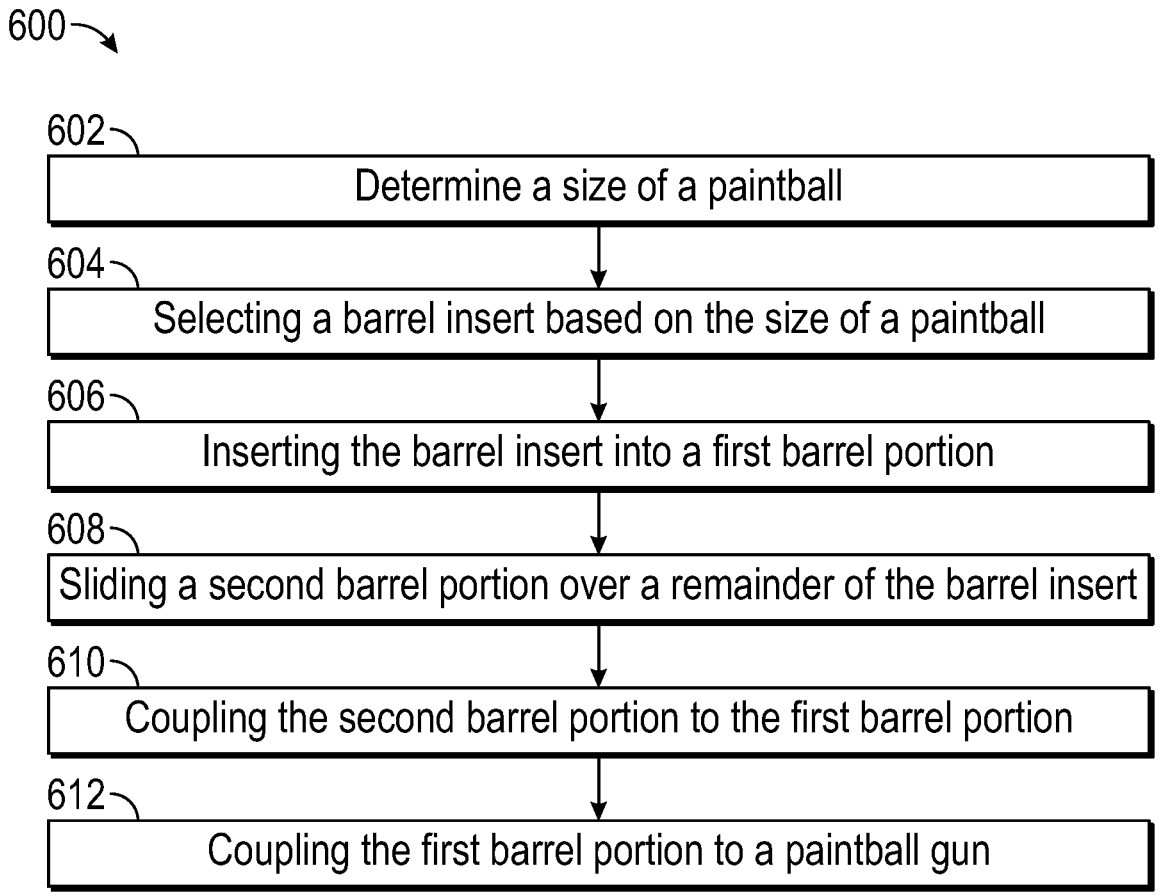
FIG. 6 illustrates an example method of assembling a barrel assembly for a paintball gun.

FIG. 6 illustrates an example process 600 of assembling the barrel assembly 100 for a paintball gun (e.g., the paintball gun 10). At block 602, a size of a paintball is determined. At block 604, an insert is selected based on the size of the paintball. At block 606, the selected insert is inserted into a first barrel portion (e.g., the first barrel portion 110). In some implementations, the insert can include a ridge that can engage (e.g., rest against) an opening or an end (e.g., the distal end 214) of the first barrel portion. At block 608, a second barrel portion (e.g., the second barrel portion 150)

is slid over a remainder of the selected insert. At block 610, the second barrel portion is coupled to the first barrel portion. As described herein, the second barrel portion can include a fitting (e.g., the fitting 256) that can couple to a corresponding thread (e.g., the distal threaded portion 218) of the first barrel portion. In some implementations, the fitting can rest against the ridge of the insert such that the insert is fixedly positioned between the fitting of the second barrel portion and, for example, an opening or an end of the first barrel portion, thereby fixedly positioning the insert within bores of the first barrel portion and the second barrel portion. Once the first barrel portion and the second barrel portion are coupled, the first barrel portion can be coupled to a paintball gun (e.g., via the barrel adapter 14).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A paintball gun barrel assembly comprising:

a first barrel portion comprising a proximal end, a distal end, a proximal threaded portion, and a distal threaded portion, the proximal threaded portion of the first barrel portion configured to removably couple to a paintball gun;

a second barrel portion comprising a fitting with a threaded portion, the fitting configured to removably couple to the distal threaded portion of the first barrel portion, the fitting positioned about a proximal end of the second barrel portion;

an insert removably insertable within the first barrel portion and the second barrel portion, the insert comprising a first end and a second end, the first end configured to be positioned within a bore of the first barrel portion and the second end configured to be positioned within a bore of the second barrel portion;

wherein the insert comprises a ridge formed on an outer surface of the insert and positioned between the first end and the second end; and wherein the ridge is configured to abut against the distal end of the first barrel portion.

2. The barrel assembly of claim 1, wherein a height of the ridge is substantially equal to a thickness of a body of the first barrel portion to ensure that the ridge comes into contact against the distal end of the first barrel portion.

3. The barrel assembly of claim 2, wherein the ridge is configured to be fixed between the distal end of the first barrel portion and an inner surface of the fitting when the fitting of the second barrel portion is removably coupled to the distal threaded portion of the first barrel portion.

4. The barrel assembly of claim 3, wherein coupling between the first barrel portion and the second barrel portion fixes the ridge between the distal end of the first barrel portion and the inner surface of the fitting.

5. The barrel assembly of claim 2, wherein:

the insert comprises a proximal portion and a distal portion;

the proximal portion extending between the first end and the ridge;

the distal portion extending between the ridge and the second end.

6. The barrel assembly of claim 5, wherein lengths of the proximal portion and the distal portion are equal.

7. The barrel assembly of claim 5, wherein a length of the distal portion is greater than a length of the proximal portion.

8. The barrel assembly of claim 5, wherein a length of the proximal portion is greater than a length of the distal portion.

9. The barrel assembly of claim 1, wherein the first end of the insert aligns with the proximal end of the first barrel portion when the insert is fully inserted into the first barrel portion.

10. The barrel assembly of claim 1, wherein the second barrel portion comprises a plurality of openings configured to allow air and paint to exit from a bore of the second barrel portion.

11. The barrel assembly of claim 10, wherein the plurality of openings comprise one or more circular vents and one or more slits formed and positioned along at least a portion of a length of the second barrel portion.

12. A method providing a barrel with an insert for a paintball gun, the method comprising:

selecting an insert based at least in part on a size of a paintball;

inserting a proximal portion of the insert into a proximal barrel portion comprising a proximal end and a distal end;

inserting a distal portion of the insert into a distal barrel portion comprising a proximal end and a distal end;

coupling the distal end of the proximal barrel portion to the proximal end of the distal barrel portion; and coupling the proximal end of the proximal barrel portion to a paintball gun, wherein inserting the proximal portion of the insert into the proximal barrel portion includes inserting the insert into the proximal barrel portion so that a ridge on an outer surface of the insert abuts against the distal end of the proximal barrel portion and wherein coupling the distal end of the proximal barrel portion to the proximal end of the distal barrel portion includes coupling the proximal barrel portion and the distal barrel portion so that the ridge is positioned between the proximal barrel portion and the distal barrel portion.

13. The method of claim 12, wherein the selecting of the insert comprising:

comparing the paintball with a plurality of openings of a sizing device, each of the plurality of openings of the sizing device associated with a corresponding bore size of a given insert;

based at least in part on the comparison of the paintball and the plurality of openings of the sizing device, identify an opening from the plurality of openings; and selecting the insert having a bore size corresponding to the identified opening.

14. The method of claim 12, wherein:

the distal end of the proximal barrel portion comprises a threaded portion and the proximal end of the distal barrel portion comprises a fitting; and the coupling of the distal end of the proximal barrel portion to the proximal end of the distal barrel portion comprises removably coupling the fitting of the proximal end of the distal barrel portion to the threaded portion of the distal end of the proximal barrel portion.

15. A kit for a paintball gun, the kit comprising;

a first barrel portion comprising a proximal threaded portion and a distal threaded portion, the proximal threaded portion of the first barrel portion configured to removably couple to a paintball gun;

a second barrel portion comprising a fitting with a threaded portion, the fitting configured to removably couple to the distal threaded portion of the first barrel portion;

a plurality of inserts configured to be inserted into the first barrel portion and the second barrel portion, each of the plurality of inserts having a different bore size, wherein the each of the plurality of inserts comprises a ridge formed on an outer surface thereof, the ridge positioned between a proximal end and a distal portion of each of the plurality of inserts; and wherein the ridge is configured to abut against the distal end of the first barrel portion.

16. The kit of claim 15, wherein the ridge is configured to be positioned and fixed between the distal end of the first barrel portion and a proximal end of the second barrel portion to thereby fix a position of the insert relative to the first and second barrel portions.

17. The kit of claim 15 further comprising a sizing device comprising a plurality of openings, wherein each of the plurality of openings correspond to different paintball sizes and bore sizes of the plurality of inserts.

18. The kit of claim 15, wherein the plurality of inserts are in different colors each corresponding to different inner diameter size.

19. The kit of claim 15 further comprises a plurality of barrel grips configured to removably wrap around an outer surface of the first barrel portion and provide improved grip for a user.

20. The kit of claim 19, wherein the plurality of barrel grips are in different colors.

* * * * *